United States Patent [19]

Fukuda

[11] 4,115,077

[45] * Sep. 19, 1978

[54] METHOD OF CONTINUOUSLY PRODUCING RESINOID ABRASIVE WHEELS FOR CUTTING HARD MATERIALS

[76] Inventor: Heijiro Fukuda, No. 123, 3-chome, Umegaoka, Nagaokakyo, Japan, 617

[ * ] Notice: The portion of the term of this patent subsequent to Apr. 13, 1993, has been disclaimed.

[21] Appl. No.: 812,297

[22] Filed: Jul. 1, 1977

[30] Foreign Application Priority Data

Feb. 28, 1977 [JP] Japan ..... 52-21803

[51] Int. Cl.[2] ..... C09K 3/14; B24D 3/32

[52] U.S. Cl. ..... 51/296; 51/295; 51/298 R

[58] Field of Search ..... 51/295, 296, 298

[56] References Cited

U.S. PATENT DOCUMENTS

| | | | |
|---|---|---|---|
| 2,958,593 | 11/1960 | Hoover et al. | 51/298 |
| 3,474,048 | 10/1969 | Chappelear | 51/296 |
| 3,529,945 | 9/1970 | Charvat | 51/296 |
| 3,950,148 | 4/1976 | Fukuda | 51/298 |
| 3,950,149 | 4/1976 | Fukuda | 51/298 |
| 4,038,047 | 7/1977 | Haywood | 51/296 |

*Primary Examiner*—Donald J. Arnold
*Attorney, Agent, or Firm*—Allison C. Collard

[57] ABSTRACT

Resinoid abrasive wheels are continuously produced by preparing pore forming granules having predetermined mechanical strength and containing a substance thermally decomposable at a baking temperature for the production of resinoid abrasive wheels, kneading together the pore forming granules, abrasive grins, a binder, a glass fiber reinforcement and a filler to prepare an abrasive composition, molding the abrasive composition into a block, heating the block by a high frequency heater, rolling the heated block into a sheet by rolls, blanking out circular pieces from the sheet, and baking the circular pieces of the uncured abrasive composition containing the pore forming granules uniformly dispersed therein to cure the binder and form pores by the decomposition of at least part of the thermally decomposable substance contained in the granules, whereby resinoid abrasive wheels having pores uniformly dispersed therein are obtained.

13 Claims, 11 Drawing Figures

METHOD OF CONTINUOUSLY PRODUCING RESINOID ABRASIVE WHEELS FOR CUTTING HARD MATERIALS

BACKGROUND OF THE INVENTION

The present invention relates to a method of continuously producing resinoid abrasive wheels for cutting hard metal materials, especially superhard metal materials such as stainless steel and special steel.

Generally, pores play an important role in resinoid abrasive wheels for cutting hard materials. When a hard metal material is cut by such a resinoid abrasive wheel, the pores in the wheel permit escape of particles of the cut material and reduce heat generation during the cutting operation. The presence of the pores further permits abrasion of the wheel, whereby refreshing the abrasive surface at all times so that the wheel retains a high cutting performance for a prolonged period of time. Accordingly, such effects are not achievable if the amount of the pores is less than is desired, whereas the presence of an excessive amount of pores will reduce the strength of the wheel. Thus the amount of pores is closely related to the cutting performance and strength of the abrasive wheel. It is therefore desired that a suitable amount of pores be present in the abrasive wheel in a well-balanced uniform distribution.

The present inventor has already proposed in U.S. Pat. No. 3,950,149 a method for continuously producing resinoid abrasive wheels comprising the steps of kneading abrasive grains and a binder together, molding the resulting composition into a block, heating the block by a high frequency heater, rolling the heated block into a sheet, blanking out circular pieces from the rolled sheet, and baking the circular pieces. With this method and other conventional methods, a foaming agent is used to form pores in the resinoid abrasive wheel. Stated more specifically, the foaming agent is admixed with the abrasive grains in a specified ratio in the kneading step, such that the foaming agent forms pores in the abrasive wheel on chemical reaction.

However, when chemically reacted, the foaming agent forms pores of varying sizes and shapes in the resulting abrasive mixture. Further when the uncured abrasive mixture is rolled on the opposite sides in the rolling step, not a few pores are broken down and disappear. For these reasons, it has heretofore been impossible to form within the resinoid wheel a sufficient amount of pores of uniform size and shape, with the resulting problem that the resinoid wheel produced by the convention methods is not fully satisfactory in curing performance.

SUMMARY OF THE INVENTION

This invention provides a method of continuously producing resinoid abrasive wheels which is characterized by the steps of preparing pore forming granules having predetermined mechanical strength and containing a substance thermally decomposable at a baking temperature for the production of resinoid abrasive wheels, kneading together the pore forming granules, abrasive grains and a binder to prepare an abrasive composition, molding the abrasive composition into a block, heating the block by a high frequency heater, rolling the heated block into a sheet by a multiplicity of pairs of rolls, blanking out circular pieces from the sheet, and baking the circular pieces to cure the binder and form pores in the resulting abrasive wheels by the decomposition of at least part of the thermally decomposable substance contained in the granules.

According to the method of this invention, a required amount of pores of size and shape corresponding to the size and shape of the pore forming granules can be formed in the resinoid abrasive wheel as uniformly distributed therein, so that the resinoid abrasive wheels continuously produced have outstanding cutting performance and high mechanical strength.

If the pore forming granules to be incorporated into the abrasive composition are of uniform size and shape, the pores formed are of uniform size and shape in corresponding relation to the granules. Because the amount of the pore forming granules proportionally relates to the amount of pores formed and further because the pore forming granules are incorporated into the abrasive composition as uniformly dispersed therein, the pores can be formed in the abrasive wheel as uniformly distributed therein. Accordingly, the size, shape and amount of the pores to be formed in the abrasive wheel can be substantially accurately determined. This makes it possible to establish with substantial accuracy the relationship between the pores and the cutting performance and strength of the resinoid abrasive wheel. Thus, the resinoid abrasive wheels produced by the present process have high mechanical strength and outstanding cutting performance in that they are very sharp, give a cut surface free of any scorch of distortion and cut materials accurately at right angles to the axis thereof. The pore forming granules incorporated into the abrasive composition have such mechanical strength that they withstand the pressure of pairs of rolling rolls without breaking down. The abrasive composition resulting from the kneading step and containing the pore forming granules can therefore be subjected free of any trouble to a series of steps of molding the composition into a block, heating the block by a high frequency heater, rolling the block into a sheet, and blanking out circular pieces from the sheet, whereby resinoid abrasive wheels having excellent cutting performance and high mechanical strength as mentioned above can be produced in large quantities, with high efficiency and at a low cost.

DESCRIPTION OF THE PREFERRED EMBODIMENTS

Figure 1:
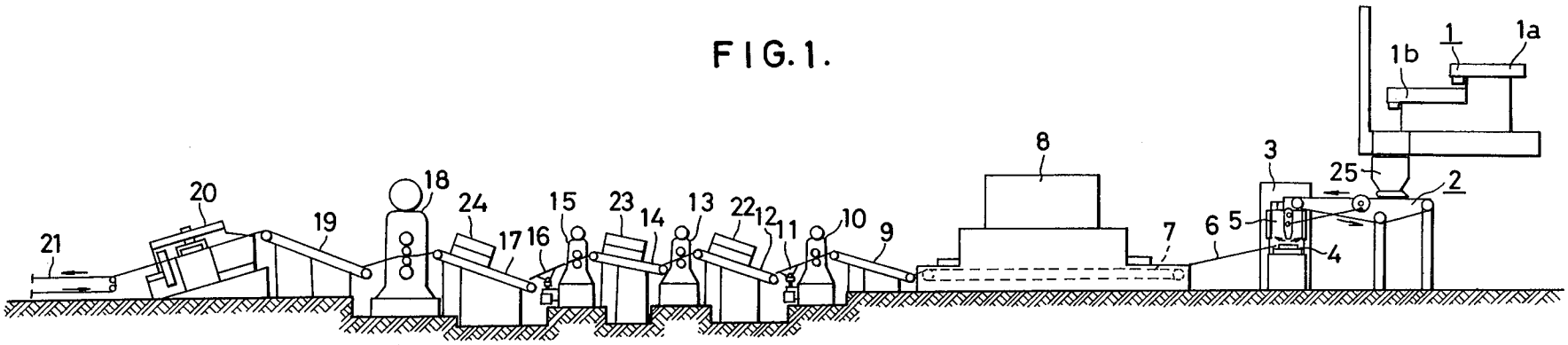
FIG. 1 is a schematic diagram showing an example of the apparatus for continuously producing resinoid abrasive wheels of this invention.

With reference to FIGS. 1 to 5, abrasive grains A, a binder B, a glass fiber reinforcement C, pore forming granules D and, when desired, a filler in predetermined proportions are kneaded in a two-stage mixer 1 to prepare an abrasive composition.

Examples of the abrasive grains A are about 16- to 220-mesh grains of silicon carbide, alumina, siliceous sand, etc. Suitable as the binder B are phenolic resin, epoxy resin, diallyl phthalate resin and like thermosetting synthetic resins. These resins are used partly in the form of a liquid. For example, one third of the whole amount of the resin is used in liquid and the remaining two thirds in particles.

The pore forming granules D are composed of a substance $D_1$ which is thermally decomposable at a baking temperature of 180° to 220° C. for the production of resinoid wheels and an aggregate $D_2$. Suitable examples of the thermally decomposable substance $D_1$ are organic substances such as starch and funori. Suitable examples of the aggregate $D_2$ are nonflammable inorganic substances such as chopped strands of glass fibers about 5 to 15$\mu$ in diameter and cut to a length, for example, of 0.1 to 1 mm.

The pore forming granules D are prepared, for example, in the following manner. The aggregate $D_2$ is prepared by cutting minute glass fibers about 5 to 15$\mu$ in diameter to a length of 0.1 to 1 mm, impregnating the fibers with a 5% to 20% solution of a liquid phenolic resin of the same type as the binder B dissolved in alcohol and drying the impregnated fibers. The aggregate $D_2$ is then admixed with starch or funori, serving as the thermally decomposable substance $D_1$, in the ratio for example of 1 to 3 parts by weight of starch or funori per part by weight of the glass fibers constituting the aggregate. A suitable amount of water is then added to the mixture, and the combined mass is fully kneaded in a mixer. The kneaded mixture is placed into a granulating machine to obtain spherical granules about 1.2 to 1.5 mm in diameter. The granules are slowly dried for 5 to 10 minutes and thereafter dried at 80° to 120° C. The pore forming granules D thus obtained are substantially spherical, contain the thermally decomposable substance $D_1$ such as starch and have such mechanical strength that they withstand the pressure of a multiplicity of pairs of rolling rolls. The pore forming granules D are not limited to the above-mentioned example but may be composed of any material insofar as they fulfil the requirements of containing the substance $D_1$ as specified above and having the desired mechanical strength to withstand the rolling pressure.

Useful examples of the glass fiber reinforcement C are chopped strands of glass fibers 10 to 15$\mu$ in diameter and 5 to 15 mm in length. Like the glass fibers used as the aggregate $D_2$ of the pore forming granules D, it is preferable to use the glass fiber reinforcement C as surface-treated by impregnated with a dilute solution of a liquid phenolic resin, followed by drying. The glass fiber reinforcement C reinforces the resinoid abrasive wheel and entangled with the abrasive grains A and the pore forming granules D, holding the granules D in engagement with the abrasive grains A.

Examples of useful fillers are cryolite, iron disulfide, red iron oxide, clay, etc.

The ingredients of the abrasive composition are kneaded together for example in the following order.

First, the abrasive grains A and the binder B are kneaded in a first mixer 1*a* on a higher level. Used as the binder B is for example a phenolic resin, about one third of the amount of which is admixed in a liquid form with the abrasive grains A in the first mixer 1*a*.

Pore forming granules D, 1.2 to 1.5 mm in diameter and prepared as described above, are then slowly added to and uniformly dispersed in the mixture. The pore forming granules D are used in such an amount that for example about 5 to 20% by volume of pores E can be formed within the resinoid abrasive wheel obtained. The amount of the pore forming granules D used, although variable with the materials used, is generally 3 to 20 parts by weight per 100 parts by weight of the abrasive grains A. Subsequently, chopped strands of glass fiber C, 10 to 15$\mu$ in diameter and 5 to 15 mm in length, are gradually added to and uniformly dispersed in the uniform mixture of the abrasive grains A, liquid binder B and pore forming granules D. The glass fiber reinforcement C is used in an amount for example of 4 to 10 parts by weight per 100 parts by weight of the abrasive grains A. It is preferable to use the glass fibers in two different lengths, e.g. 5 mm and 15 mm, at the same time. Further as already stated, the glass fibers may preferably be surface-treated before the use.

On the other hand, the two-third remaining quantity of the phenolic resin is used in the form of particles. The particles of the resin are placed into a second mixer 1*b* at a lower position and mixed with a filler such as cryolite if the filler is used. The abrasive grains A, binder B and filler are used in the ratio for example of 60 to 90 parts by weight of the abrasive grains, 10 to 30 parts by weight of the binder and 0 to 20 parts by weight of the filler. The kneaded mixture in the first kneader 1*a* is placed into the second mixer 1*b*, and the combined mass is uniformly kneaded together.

The abrasive mixture run off from the two-stage mixer 1 is a uniform composition and is particulate to granular in its entirety.

The abrasive composition is then charged into the hoppers 25 of two feeders 2. The granular composition is then fed in a specified amount at a time to a lower die 4 in a block molding machine 3 by means of a slitter 42 provided at the outlet of the hopper 25 of each feeder 2 and an intermittently driven conveyor 36 having opposite side walls 43 spaced apart by a distance equal to the width of the slitter 42. The molding machine 3 includes an upper die 5 positioned at its center and two lower dies 4 alternately reciprocally movable from outside inward to a position immediately below the upper die 5 and outward therefrom. The abrasive composition is subjected by the molding machine 3 to pressure, for example, of 80 to 140 kg/cm$^2$ for 20 to 60 seconds and is thereby molded in succession into blocks having a size in the range of from 260 × 380 × 25 mm to 400 × 500 × 40 mm. The upper and lower dies 5 and 4 are heated to a temperature, for example, of 70° to 80° C.

The molded block is then transferred by a chute 6 onto a first conveyor 7, which passes the block through a high frequency heater 8 to heat the block for example at a temperature of 45° to 75° C. The high frequency heater 8 is used to instantaneously heat the block to a predetermined temperature throughout its innermost portion, whereby the block is suitably softened owing to the tackiness of the binder and thereby rendered rollable. Furthermore since the interior portion of the block is maintained at a slightly higher temperature than the outside portion of the block, the block can be rolled advantageously without sticking to the rolls. The high frequency heater is more specifically a high frequency induction heater. During the heating step, the pore forming granules remain in their original form within the block free of any change.

The block heated by the high frequency heater is then transferred by a second conveyor 9 continuous with the first conveyor 7 to first rolls 10 for rolling. The rolled sheet obtained is then placed onto a first turntable 11, turned 90° and sent by a third conveyor 12 to second rolls 13, whereby the rolled sheet shaped by the first rolls is rolled transversely. The resulting rolled sheet is thereafter carried on a fourth conveyor 14 to third rolls 15 and rolled. The sheet is further transferred onto a second turntable 16, turned 90° and then carried by a fifth conveyor 17 to a fourth unit of four high-precision rolls 18 which are vertically arranged in a row, whereby the abrasive sheet is eventually made into a sheet measuring 400 to 1,200 mm in width and 1 to 15 mm in thickness. Because the pore forming granules D have such mechanical strength that they withstand the pressure of the multiplicity of pairs of rolls, the uncured abrasive sheet resulting from the rolling step contains the pore forming granules D remaining in their original state and uniformly dispersed therein. Preferably, the fourth rolls 18 are covered with rubber, in which case the rolling operation permits the abrasive grains A to be exposed from the front and rear surface of the sheet, rendering the sheet rough-surfaced. Abrasive wheels having such rough surfaces ensure a very efficient cutting operation. The third, fourth and fifth conveyors 12, 14 and 17 are provided thereabove with infrared heaters 22, 23 and 24 or like means to maintain the abrasive sheet at the specified temperature.

The uncured abrasive sheet thus rolled to the predetermined thickness of 1 to 15 mm is then fed by a sixth conveyor 19 to a blanking press 20, by which circular pieces, for example 200 to 860 mm in diameter, are blanked out from the sheet.

Figure 3:
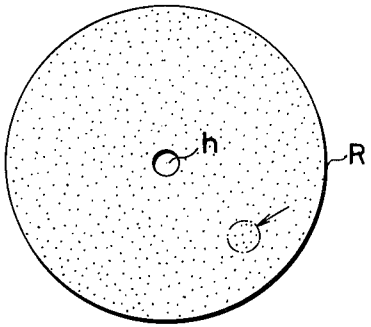
FIG. 3 is a plan view showing a resinoid abrasive wheel of this invention for illustrative purposes.

FIG. 3 shows a resinoid abrasive wheel R in the form of a circular sheet and having a center bore *h*.

Figure 4:
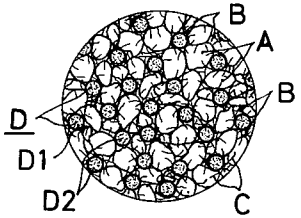
FIG. 4 is an enlarged plan view of a portion of FIG. 3 indicated by the arrow to illustrate the structure of the wheel before baking.

FIG. 4 shows the structure of the wheel R in the uncured state before baking. It is seen that the pore forming granules D are uniformly distributed among numerous abrasive grains A, and the reinforcing glass fibers are entangled with these granules and grains, preventing disengagement of the granules D. The grains A, granules D and glass fibers C are bonded together by the binder B into a body. The pore forming granules D is composed of a substance $D_1$ such as starch which is decomposable at an abrasive wheel baking temperature and an aggregate $D_2$ such as glass fiber pieces. The granules are substantially spherical and have mechanical strength sufficient to withstand the pressure of the multiplicity of pairs of rolls against rupture.

The uncured circular abrasive pieces are then fed by a seventh conveyor 21 to a baking furnace (not shown). The scrap resulting from the blanking step is sent by a return conveyor (not shown) to a kneader (not shown) for reuse.

In the baking furnace, the uncured circular pieces are placed between polished iron discs and baked at a temperature suitable for the curing of the synthetic resin used as the binder. For example, the circular pieces are heated progressively from room temperature to 180°-220° C. over a period of about 1 day when a phenolic resin is used as the binder.

Figure 5:
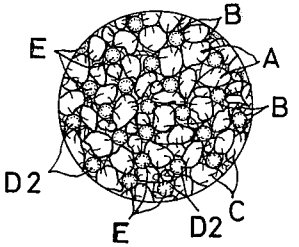
FIG. 5 is an enlarged plan view of the same after baking.

The thermally decomposable substance $D_1$ constituting the pore forming granules D is at least partially decomposed or burned by the baking, forming pores E at the locations where the granules D were present as shown in FIG. 5. The baking operation reduces the granules D to a minor amount of the aggregate $D_2$ and a small amount if any of the undecomposed starch or like substance $D_1$, with the result that the pores E are of substantially uniform size and shape corresponding to the size and shape of the pore forming granules D, the pores E being uniformly distributed throughout the abrasive wheel. Useful as the baking furnace is for example an electric furnace of the tunnel type.

Apparatus such as one described above for continuously producing resinoid abrasive wheels are disclosed in the applicant's U.S. Pat. Nos. 3,980,453 and 3,999,919.

Figure 7:
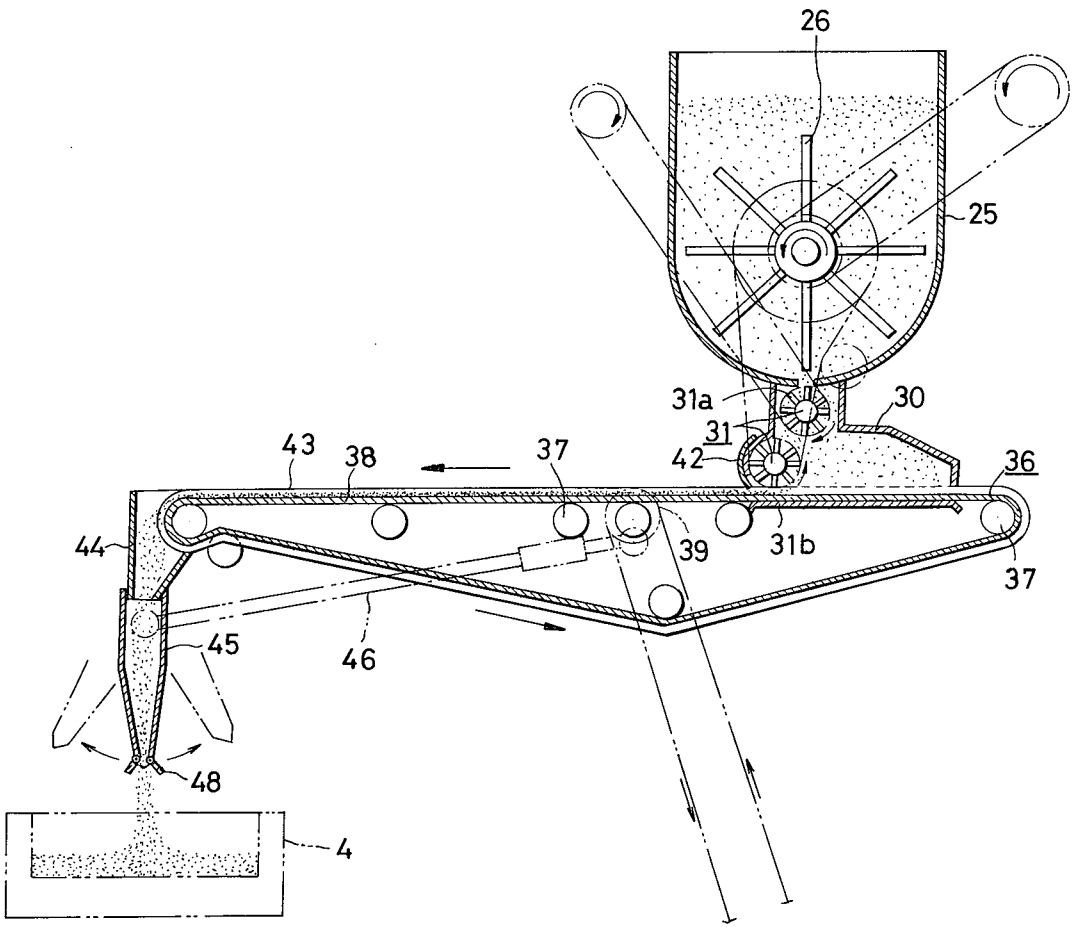
FIG. 7 is a view partly in vertical section and showing the feeder of FIG. 6.
Figure 6:
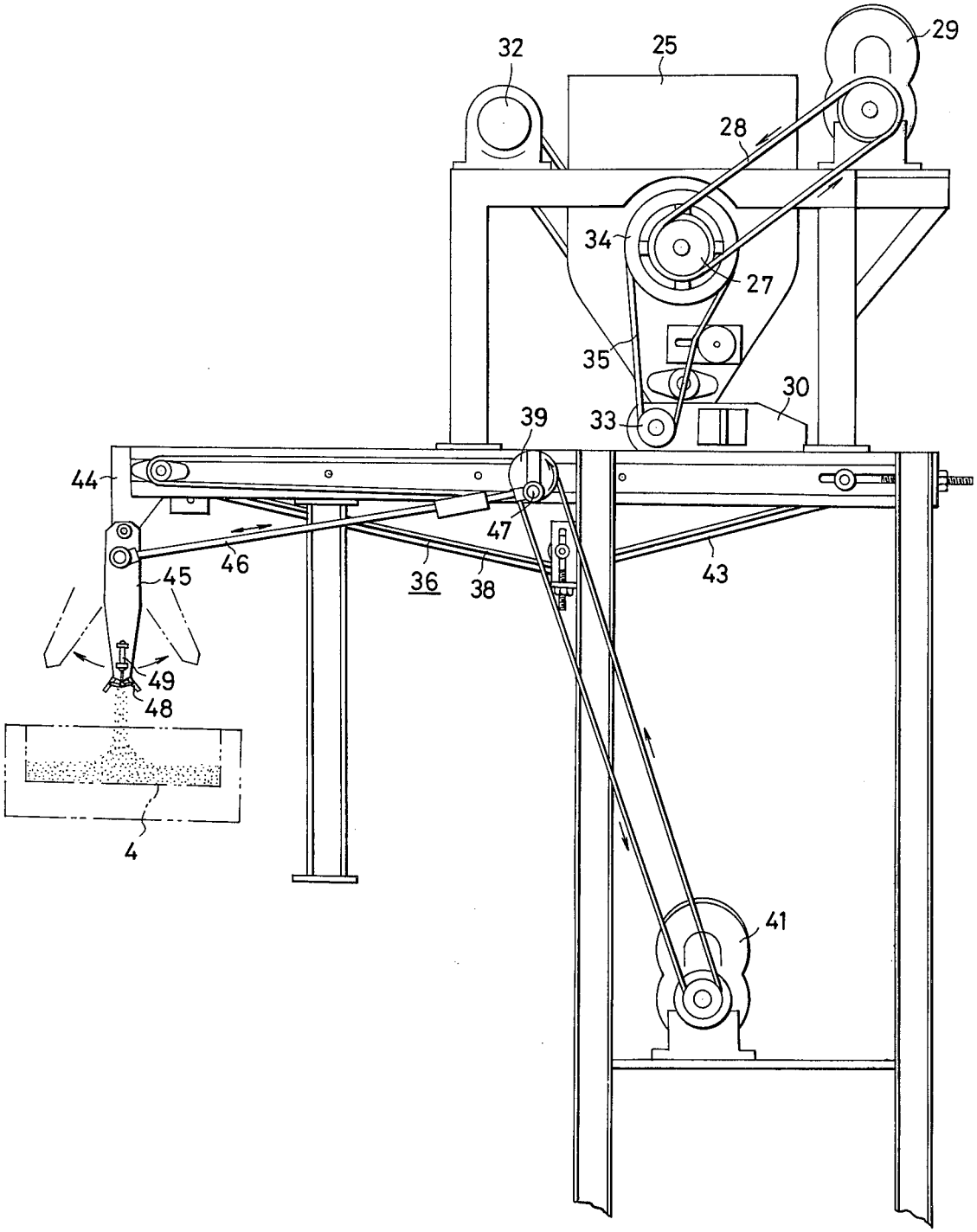
FIG. 6 is an enlarged side elevation showing an abrasive composition feeder.

With reference to FIGS. 6 and 7, an embodiment of the feeder 2 for feeding the abrasive composition at a constant rate will be described.

The abrasive composition prepared by the mixer 1 of the two-stage type is charged into the hoppers 25. Disposed in each of the hoppers 25 is a blade agitator 26 which is driven by a motor 29 through a belt 28 and a drive sprocket 27 mounted on the same shaft as the agitator 26 and disposed outside the hopper 25. The abrasive composition is discharged from the bottom outlet of the hopper 25 onto a belt conveyor 36 while being crushed by a two-stage crusher 31 disposed in a compartment 30 positioned under and communicating with the hopper 25. The endless belt 38 of the belt conveyor 36 is provided at its opposite sides with upstanding walls 43 which are spaced in parallel to each other. The conveyor 36 is adapted to be intermittently driven by a motor 41 and an unillustrated timer. On the outer side of the front wall of the compartment 30, there is provided a slitter 42 which is positionable at an adjusted level. The upstanding walls 43 and slitter 42 serve to permit the abrasive composition to be carried on the travelling conveyor 36 uniformly over a definite width, so that a specified amount of the composition can be sent forward by the conveyor being driven for a specified time determined by adjusting the unillustrated timer. At the front end of the belt conveyor 36, there is disposed a chute 44 having an opening at its lower end which pivotably carries a feed tube 45. The feed tube 45 is connected by a link 46 to a projection 47 eccentrically mounted on a drive sprocket 39 for the belt conveyor 36. The feed tube 45 is therefore movable back and forth in timed relation to the travel of the belt conveyor 36, whereby the abrasive composition can be placed into the lower dies 4 of the block molding machine 3 to a uniform thickness. The lower end of the feed tube 45 is provided with a closure 48 which can be opened and closed by the operation of a cylinder 49. The closure 48 prevents the abrasive composition from dropping from the lower end while the belt conveyor 36 is held out of operation. The upper crusher member 31*a* of the cursher 31 is driven by a motor 32, whilst the lower crusher member 31*b* thereof is driven by the motor 29 through a belt 35 reeved around a sprocket 33 mounted on the same shaft as the crusher member 31*b* and around a sprocket 34 on the same shaft as the drive sprocket 27.

Such feeder 2 is disclosed in the applicant's U.S. Pat. No. 3,964,849.

Figure 9:
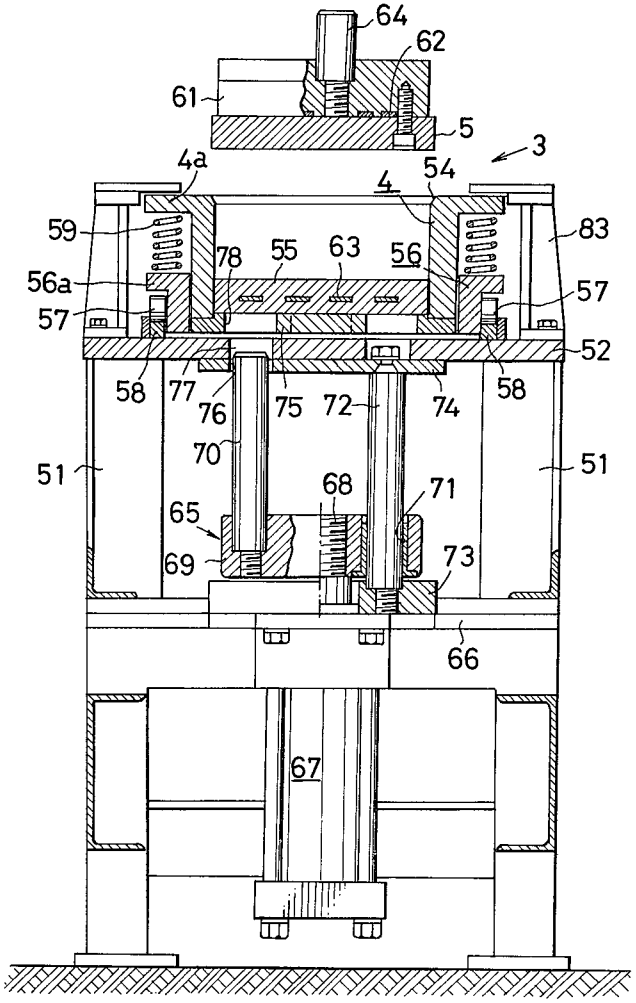
FIG. 9 is a view in vertical section showing the machine of FIG. 8.
Figure 8:
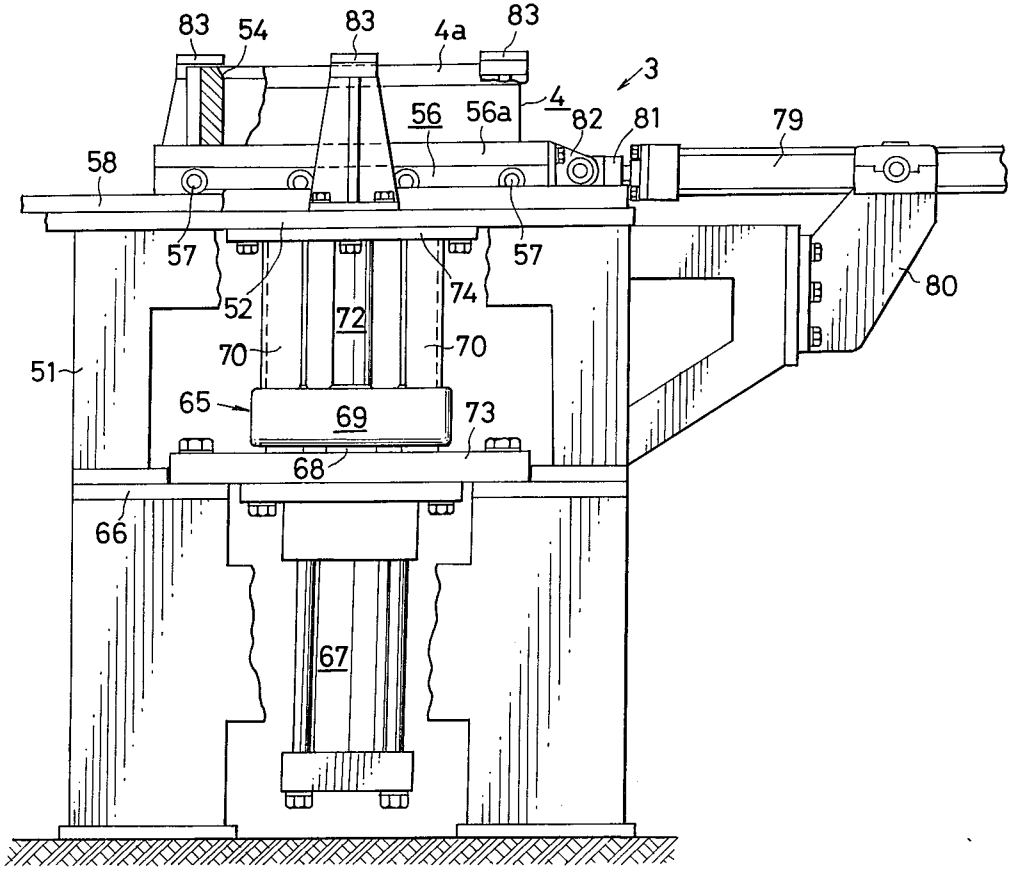
FIG. 8 is an enlarged side elevation partly broken away and showing a block molding machine.

With reference to FIGS. 8 and 9, an embodiment of the block molding machine 3 will be described below.

The machine 3 includes support columns 51 on the top ends of which an upper plate 52 is placed. Rails 58 extend over the entire length of the upper plate 52. The lower die 4 is chamfered along the peripheral edge of its opening 54 and has a bottom plate 55 detachably loosely fitting therein. The die is mounted on a box-shaped carriage 56 having an open top.

The carriage 56 is provided on its outer opposite sides with eight rollers 57 placed on the rails 58. Two carriages 56 and two lower dies 4 are provided. Springs 59 are interposed between an outer flange 4*a* at the upper end of each lower die 4 and an outer flange 56*a* at the upper end of the carriage 56 to reduce the pressing load on the rollers 57. The upper die 5 is in the form of a flat plate and has the same shape as the opening of the lower die 4 in plan view. The upper die 5 is secured to a die holder 61 which in turn is connected to the end of a ram 64 for raising and lowering the die 5. The upper die holder 61 and the bottom plate 55 of the lower die 4 are provided with heaters 62 and 63 respectively.

Knockout means 65 disposed on the opposite outer sides of the upper die 5 are mounted on lateral supports 66 extending between the support columns 51. Each of the knockout means 65 has a hydraulic cylinder 67 including an upwardly extending rod 68 the top end of which carries a vertically movable knockout holder 69 provided with four knockout pins 70. The knockout holder 69 is formed with four bores 71 extending therethrough and receiving therein guide posts 72 respectively. The guide posts 72 are secured at their lower ends to a mounting plate 73 on the lateral support 66 and have upper ends secured to a mounting plate 74 on the bottom surface of the upper plate 52.

The knockout pins 70 are raised by the operation of the cylinder 67, passing though bores 76, 77 and 78 continuously extending through the mounting plate 74, upper plate 52 and the bottom plate of the carriage 56. On reaching the bottom plate 55 of the lower die 4, the knockout pins 70 push up the bottom 55 from below.

On an outer side of each of the lower dies 4, there is disposed a hydraulic cylinder 79 supported by an arm 80. The rod 81 of the cylinder 79 is connected at its front end to a projection 82 on an outer side of the carriage 56. By the operation of the pair of hydraulic cylinders 79, the pair of lower dies 4 secured to the carriages 56 are alternately reciprocally moved inward to a position immediately below the upper die 5. A desired number of guides 83 are mounted on the opposite sides of the plate 52.

The kneaded abrasive composition is fed first to the lower die 4 positioned on one side of the upper die 5. The hydraulic cylinder 79 operates, driving the carriage 56 carrying the lower die 4 and bringing the die 4 to the position immediately below the upper die 5, whereupon the upper die 5 descends and molds the composition into a block of specified size by pressure. At this time, the upper and lower dies 5 and 4 are heated to a temperature of 70 to 80° C. by the heaters 62 and 63.

During the above-mentioned operation, the abrasive composition is placed into the lower die 4 on the other side of the upper die 5. The lower die 4 which has finished the molding operation is retracted sidewise from below the upper die 5. Simultaneously with this, the lower die 4 on the other side is brought to the position below the upper die 5, and the abrasive composition therein is similarly compressed to a molded block. At the stopped positions of the lower dies 4 on the opposite outer sides of the upper die 5, the knockout means 65 operate, causing their knockout pins 70 to push up the bottom plates 55 of the lower dies 4 respectively. In this way, the abrasive composition is molded into blocks in succession by one upper die 5 and two lower dies 4.

Figure 10:
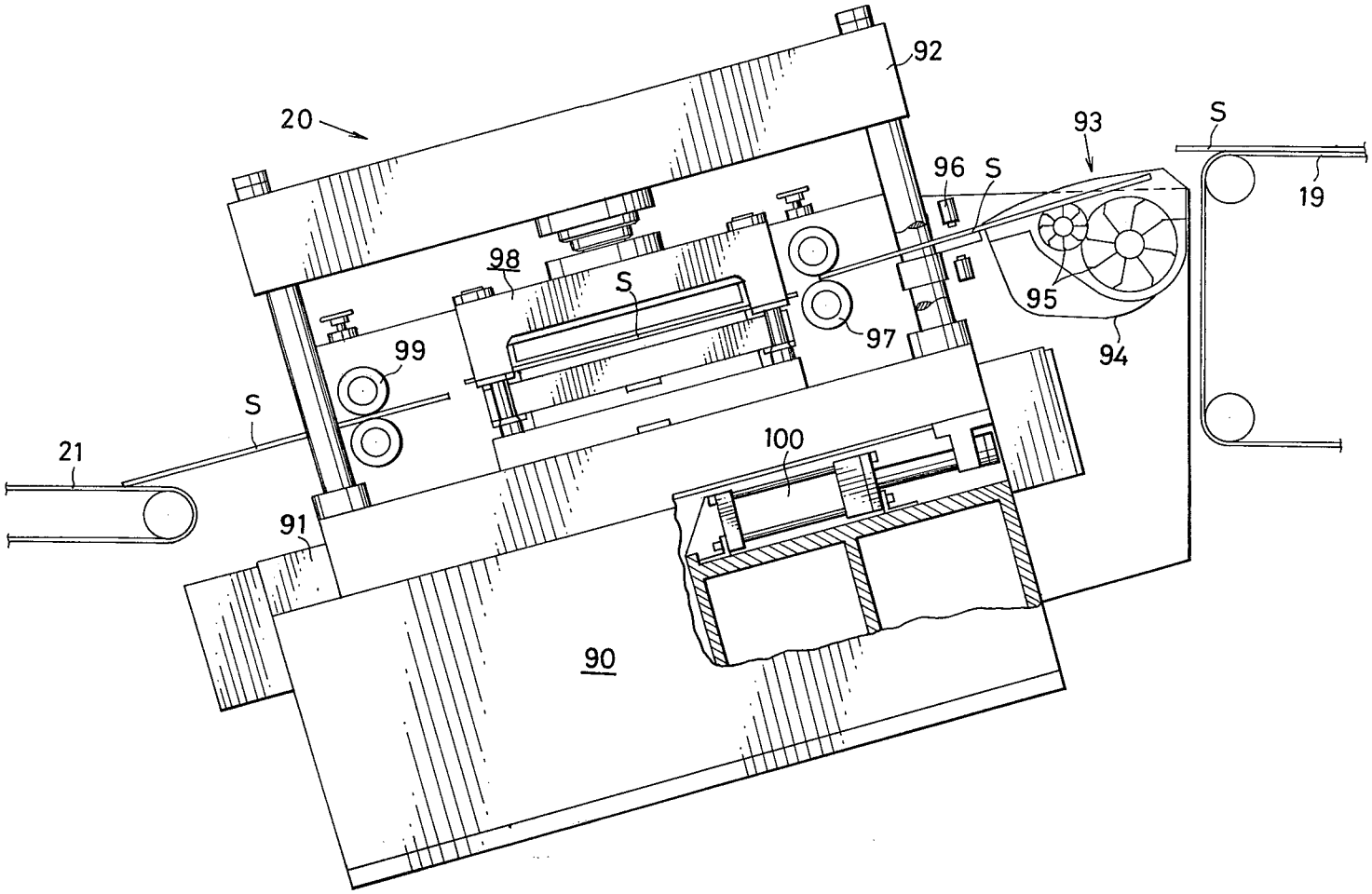
FIG. 10 is an enlarged side elevation showing a blanking press.
Figure 11:
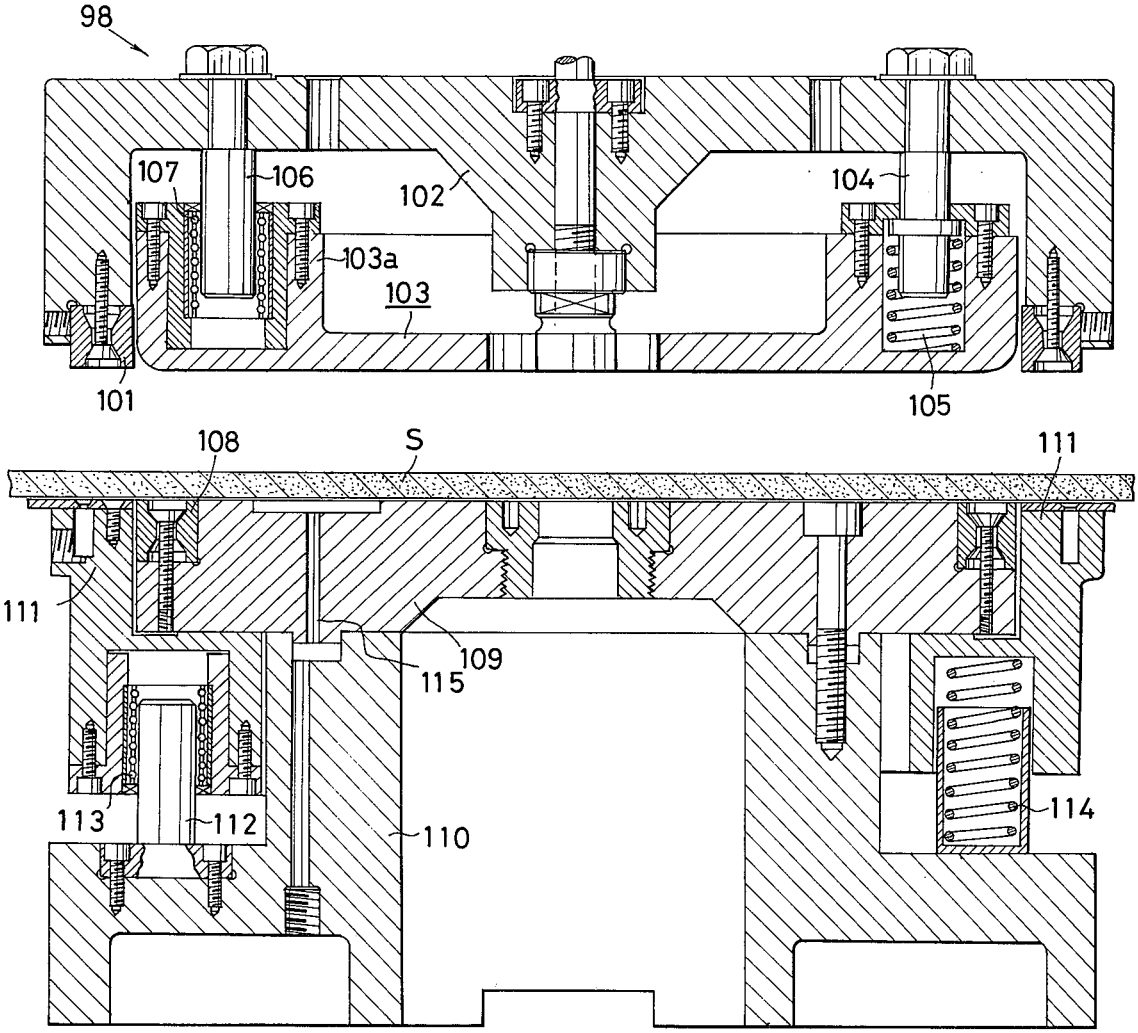
FIG. 11 is a fragmentary enlarged view in section of the blanking press shown in FIG. 10.

With reference to FIGS. 10 and 11, an embodiment of the blanking press 20 will be described.

The press includes a base frame 90 which is inclined progressively downward from one side of the press for feeding uncured abrasive sheets S toward the other outlet side. The base frame 90 has a guide portion 91 along its upper edge. A slidable body 92 reciprocally movable by a cylinder 100 in a slanting direction fits over the guide portion 91. Disposed between the base frame 90 and the sixth conveyor 19 for feeding the uncured abrasive sheets S is a release agent applicator 93 comprising a container 94 containing sand or like release agent and two blade wheels 95 housed within the container 94. The release agent is applied to the rear side of the sheet S which is still tacky when the sheet passes over the applicator 93. A photoelectric tube 96 disposed adjacent the applicator 93 detects the passage of the sheet S to determine the operation timing for the slidable body 92. The sheet S passes between feed rollers 97 and is sent into the middle of a blanking die set 98 positioned centrally of the slidable body 92. The die set 98 blanks out circular pieces from the sheet S.

The die set 98 will now be described in greater detail with reference to FIG. 11.

An upper annular blade 101 is secured to the lower end of the peripheral portion of an upper blade holder 102 substantially in the form of a disk and vertically movable. The upper blade holder 102 has in its bottom a recess accommodating a circular movable member 103 having an upstanding flange 103*a* along its periphery and suspended from the holder 102 by four pins 104. The flange 103*a* of the movable member 103 is formed with four cavities having the suspension pins 104 inserted therein. The cavities also accommodate springs 105. Four rods 106 are suspended from the upper blade holder 102 and have lower ends slidably supported by ball slide bearings 107 housed in the four cavities in the flange 103*a* of the movable member 103.

A lower annular blade 108 is secured to a lower blade holder 109 secured to a frame 110. Disposed around the lower blade 108 is an annular movable member 111 for receiving the upper blade 101. The movable member 111 is provided in its lower portion with ball slide bearings 113 for supporting rods 112 extending upward from the frame 110. Springs 114 are provided between the movable member 111 and the frame 110. A compressed air channel 115 extends through the frame 110 and through the lower blade holder 109 for forcing release air against the rear side of the abrasive sheet S when circular pieces are blanked out. The air channel 115 is provided to ensure smooth movement of the sheet S like the release agent applicator 93. Accordingly either the channel or the applicator may be provided.

The abrasive sheet S transferred from the sixth conveyor 19 is detected by the photoelectric tube 96, whereupon the slidable body 92 is intitiated into operation. The sheet S is fed in its slanting position to the die set 98 by way of the feed rollers 97. Simultaneously with this, the slidable body 92 and the die set 98 move in the same downwardly slanting direction as the direction of advance of the sheet S, sliding along the guide portion 91 of the frame 90. With this movement, the upper blade 101 on the upper die of the die set 98 descends into contact with the lower annular movable member 111. At the same time, the lower blade 108 and the holder 109 push up the upper movable member 103, whereby a circular piece is blanked out from the sheet S held between the upper and lower dies. The circular abrasive piece thus blanked out is forced out by the leading end of the following advancing abrasive sheet S and is drawn out by withdrawing rollers 99 onto the seventh conveyor 21.

Such block molding machine 3 and blanking press 20 are disclosed in the applicant's U.S. Pat. No. 3,999,919.

Example of this invention will be described below.

EXAMPLE

Figure 2:
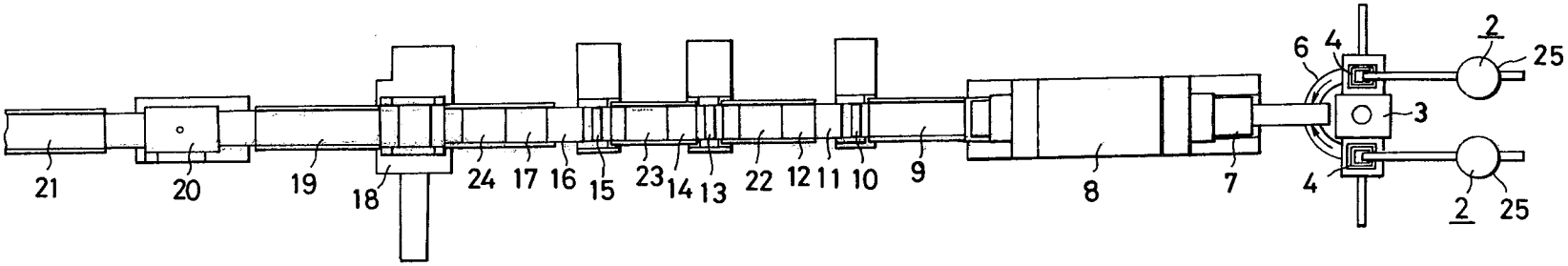
FIG. 2 is a plan view showing the apparatus of FIG. 1.

Resinoid abrasive wheels were produced according to the present method with the use of the apparatus shown in FIGS. 1 and 2.

Pore forming granules D were prepared in the following manner. Glass fibers about 5 to 15$\mu$ in diameter were cut to a length of 0.5 to 1 mm, then impregnated with a dilute solution of liquid phenolic resin and thereafter dried to obtain an aggregate $D_2$. The aggregate $D_2$ was admixed with starch serving as the thermally decomposable substance $D_1$ in such a ratio that 2 parts by weight of starch was used per part by weight of the glass fibers constituting the aggregate. With addition of a suitable amount of water, the mixture was fully kneaded in an unillustrated mixer. The kneaded mixture was placed into an unillustrated granulating machine and shaped into spherical granules about 1.2 to 1.5 mm in diameter. The granules were slowly dried for about 5 to 10 minutes and finally dried at 80° to 120° C. The pore forming granules D thus produced were substantially spherical, contained starch as the thermally decomposable substance $D_1$ and had mechanical strength to withstand the pressure of multiple pairs of rolls.

The following ingredients including the pore forming granules D were kneaded in the two-stage mixer 1 to prepare a resinoid abrasive composition.

| Abrasive composition | Amount | |
|---|---|---|
| Ingredient | kg | parts by weight |
| Abrasive grains A: | 120 | 100 |
| Mixture of equal amounts of 20-mesh Alundum A and 24-mesh Alundum A | | |
| Binder B: | | |
| Liquid phenolic resin (BRL-1251) | 7.2 | 6 |
| Powdery phenolic resin (BRP-5417) (both products of Union Carbide Corporation) | 14.4 | 12 |
| Glass fiber reinforcement C: | 6 | 5 |
| Chopped strands of glass fibers 5 to 15 mm in length and 10 to 15 $\mu$ in diameter | | |
| Pore forming granules D: | 6 | 5 |
| Prepared from glass fiber particles and starch as stated above | | |
| Filler: | 19.32 | 16.1 |
| Iron Disulfide | | |
| Antifoaming agent: | 0.66 | 0.55 |
| CML-31 (product of Ohmi Chemical Co., Ltd., Japan) | | |

The ingredients were kneaded together in the following order. First, the whole amount of the abrasive grains A and the liquid phenolic resin serving as the binder B were kneaded in the first mixer 1*a* for about 5 minutes to wet the abrasive grains uniformly with the liquid phenolic resin. Next, all the pore forming granules D were gradually sprinkled into the mixer 1*a*, and the grains A, liquid binder B and pore forming granules D were uniformly kneaded together. One half the amount of the glass fiber reinforcement C was then placed into the first mixer 1*a* through a screen, and the mixture was uniformly kneaded.

On the other hand, the powdery phenolic resin binder B, iron disulfide serving as the filler and antifoaming agent were kneaded together in the second mixer 1*b* for about 8 minutes, and the remaining half amount of the glass fiber refinforcement C was uniformly added to the kneaded mixture with use of a screen. The resulting mixture was uniformly kneaded.

The mixture in the first mixer 1*a* was then placed into the second mixer 1*b*. All the ingredients were thus kneaded together in the second mixer 1*b* for 10 to 15 minutes.

The resinoid abrasive composition thus prepared in the two-stage mixer 1 was particulate to granular. The composition was charged into the hopper 25 of the feeder 2.

Subsequently, the feeder 2 feeded the abrasive composition to the lower die 4 of the block molding machine 3 in a specified amount to an approximately uniform thickness. The machine molded the composition to a block 300 mm × 420 mm × 30 mm. At this time, the upper and lower dies 5 and 4 were heated to about 70° to 80° C.

The block of abrasion composition was then heated by the high frequency heater 8 to about 70° C. throughout its interior for 15 to 25 seconds. The pore forming granules D heated in this step were found to be free of any change. The heated block was successively rolled by the four stages of rolls 10, 13, 15 and 18 into a 4-mm-thick sheet S. The pore forming granules D, having mechanical strength sufficient to withstand the rolling pressure, remained free of any change in the course of the rolling step and were contained in the sheet S as uniformly distributed therein.

The sheet S was then fed to the blanking press 20, by which circular pieces, 20 inches in diameter, were blanked out from the sheet, with a center bore *h* of 1 inch in diameter punched in the pieces.

The uncured circular abrasive pieces were finally baked in a furnace at 180° C. in a specified manner, whereby the starch contained in the pore forming granules D as the thermally decomposable substance $D_1$ was at least partially decomposed, forming pores E at the locations where the granules D were present.

The resinoid abrasive wheels thus produced were tested for cutting performance in the following manner.

The abrasive wheel, 20 inches in diameter, 4 mm in thickness and 1 inch in the diameter of center bore, was mounted on an automatic cutting tester (product of Nippon Cutting Machine Manufacturing Co., Ltd., Japan, driven by a 30-hp, 22-kw motor). The work was a solid bar 75 mm in diameter and made of usual steel (JIS S45*c*).

During the first ten passes of the cutting operation, the abrasive wheel wore away by 1 mm per pass on the average. During the following ten passes, the wheel worn away by 1.2 mm per pass on the average. The work was cut with very small to moderate friction and with extreme sharpness. Eighty percent of the cut work surfaces were free of any discoloration, and 20% disclosed to brown, hence good results. Further very few irregularities only were left over at the cut edge portion. The perpendicularity of the cut lines with respect to the axis of the work was 90 to 100%. The perpendicularlity of 100% indicates perfect agreement of the actual cut line with the predetermined cut line at right angles to the axis of the work and therefore no error.

This invention may be embodied differently without departing from the spirit and basic features of the invention. Accordingly the embodiments herein disclosed are given for illustrative purposes only and are not in any way limitative. It is to be understood that the scope of this invention is defined by the appended claims rather than by the specification and that various alterations and modifications within the definition and scope of the claims are included in the claims.

What is claimed is:

1. A method of continuously producing a resinoid abrasive wheel for cutting hard materials comprising the steps of preparing pore forming granules having predetermined mechanical strength and containing a substance thermally decomposable at a baking temperature for the production of the resinoid wheel, kneading the pore forming granules with abrasive grains and a thermosetting synthetic resin binder to prepare an abrasive composition, molding the abrasive composition into a block, heating the block by a high frequency heater, rolling the heated block containing the pore forming granules into a sheet by a multiplicity of pairs of rolls, blanking out a circular piece from the rolled sheet, and baking the circular piece to cure the binder and form pores in the resulting abrasive wheel by the decomposition of at least part of the thermally decomposable substance contained in the granules.

2. A method as defined in claim 1 wherein the pore forming granules are composed mainly of a substance thermally decomposable at an abrasive composition baking temperature of 180° to 220° C. and an aggregate.

3. A method as defined in claim 2 wherein the thermally decomposable substance is an organic substance selected from the group consisting of starch and funori, and the aggregate is an inorganic material comprising glass fiber particles 5 to 15 $\mu$ in diameter and 0.1 to 1 mm in length.

4. A method as defined in claim 2 wherein the pore forming granules are composed mainly of 1 to 3 parts by weight of the thermally decomposable substance and 1 parts by weight of the aggregate.

5. A method as defined in claim 1 wherein in the step of preparing the pore forming granules the granules are prepared by mixing together the thermally decomposable substance and an aggregate of glass fiber particles surface-treated with a dilute solution of a thermosetting resin, kneading the mixture with a suitable amount of water, granulating the kneaded mixture by a granulating machine, and drying the resulting granules.

6. A method as defined in claim 1 wherein the pore forming granules are substantially spherical and 1.2 to 1.5 mm in diameter.

7. A method as defined in claim 1 wherein the pore forming granules have mechanical strength sufficient to withstand external pressure involved in the block molding step and external pressure involved in the rolling step.

8. A method as defined in claim 1 wherein the abrasive grains are made of at least one material selected from the group consisting of silicon carbide, alumina and siliceous sand and are 16 to 220 mesh in size, and the binder is at least one thermosetting synthetic resin selected from the group consisting of phenolic resin, epoxy resin and diallyl phthalate resin.

9. A method as defined in claim 1 wherein at least one filler selected from the group consisting of cryolite iron disulfide, red iron oxide and clay is further incorporated into the abrasive composition in the kneading step.

10. A method as defined in claim 1 wherein 60 to 90 weight parts of the abrasive grains, 10 to 30 parts by weight of the binder, 0 to 20 parts by weight of a filler and the pore forming granules are kneaded together in the kneading step, the amount of the pore forming granules being 3 to 20 parts by weight per 100 parts by weight of the abrasive grains.

11. A method as defined in claim 1 wherein a glass fiber reinforcement is further incorporated into the abrasive composition in the kneading step.

12. A method as defined in claim 11 wherein 4 to 10 parts by weight of the glass fiber reinforcement is incorporated into the abrasive composition per 100 parts by weight of the abrasive grains.

13. A method as defined in claim 11 wherein the glass fiber reinforcement incorporated into the abrasive composition in the kneading step is chopped strands of glass fibers 10 to 15 $\mu$ in diameter and 5 to 15 mm in length.

* * * * *